United States Patent [19]

Schaich

[11] Patent Number: 4,558,666

[45] Date of Patent: Dec. 17, 1985

[54] ROTATING CYLINDER ENGINE AND METHOD OF OPERATING THE ENGINE

[75] Inventor: Wilbur A. Schaich, San Antonio, Tex.

[73] Assignee: Centrifugal Piston Expander, Inc., San Antonio, Tex.

[21] Appl. No.: 634,846

[22] Filed: Jul. 26, 1984

[51] Int. Cl.[4] ..... F02B 57/00

[52] U.S. Cl. ..... 123/43 R; 91/197; 91/273; 91/395; 91/398; 91/410; 92/66

[58] Field of Search ..... 91/176, 196, 197, 216 R, 91/216 A, 216 B, 217, 272, 273, 325, 395, 397, 398, 410; 92/66, 68, 147; 123/43 R, 43 B, 46 R

[56] References Cited

U.S. PATENT DOCUMENTS

| | | | |
|---|---|---|---|
| 668,822 | 2/1901 | MacLaury | 92/66 X |
| 1,158,238 | 10/1915 | Knowles | 91/176 |
| 1,380,404 | 6/1921 | Miller | 123/43 R |
| 1,764,324 | 6/1930 | Livingstone | 123/43 R X |
| 1,813,763 | 7/1931 | Price | 123/43 R |
| 1,823,132 | 9/1931 | Cunningham | 123/43 B |
| 1,917,180 | 7/1933 | Zwick . | |
| 2,334,655 | 11/1943 | Talbot | 123/43 R |
| 2,886,017 | 5/1959 | Dib . | |
| 2,982,261 | 5/1961 | McClintock | 123/43 R X |
| 3,974,801 | 8/1976 | Brown . | |
| 4,058,088 | 11/1977 | Brown . | |

FOREIGN PATENT DOCUMENTS

| | | | |
|---|---|---|---|
| 82363 | 7/1895 | Fed. Rep. of Germany | 123/43 R |
| 805456 | 5/1951 | Fed. Rep. of Germany | 123/43 R |

*Primary Examiner*—Michael Koczo

*Attorney, Agent, or Firm*—Norvell & Associates

[57] ABSTRACT

Method and apparatus for producing rotation of a power output shaft comprises a plurality of peripherally spaced cylinders disposed in generally tangential relationship to the periphery of a housing defining a cylindrical fluid pressure chamber and connected at their inner ends to such fluid pressure chamber. The housing is mounted on, and co-rotatable with the output shaft. The gas pressure in such chamber is regulated to maintain a selected value above ambient. Cooperating pistons in each of the cylinders are interconnected by connecting rods to a unidirectional clutch mounted in the fluid pressure chamber on a fixed shaft, thus forcing the cylinders to rotate when pressured gas is introduced in the outer ends of the cylinders. Inlet and exhaust valves are provided in a cylinder head mounted in the outer end of each cylinder and are operable by contact with the outer face of the respective piston. A radial exhaust port is uncovered by each piston as it nears the end of its power stroke, thus reducing the fluid pressure on the outer piston face to ambient and permitting the regulated gas pressure in the fluid pressure chamber to effect the return of the pistons to their outermost positions relative to the respective cylinders, thus producing a net unidirectional torque on the housing to rotate the output shaft.

23 Claims, 3 Drawing Figures

ROTATING CYLINDER ENGINE AND METHOD OF OPERATING THE ENGINE

BACKGROUND OF THE INVENTION

1. Field of the Invention

The invention relates to a method and apparatus for extracting mechanical energy from a pressured gas by expanding same in a plurality of peripherally spaced cylinders mounted for rotational movement about the axis of an output shaft which is co-rotatably connected to the cylinders.

2. Description of the Prior Art

The great majority of rotary engines designed for operation by a pressured gas, including a pressured gas developed by internal combustion of a mixture of a combustible fuel and air, have utilized linearly reciprocating pistons and cylinders. In most instances, the cylinders were stationary and the pistons were connected by connecting rods to a rotary crank shaft which provided the output power of the engine. The desirability of mounting a plurality of cylinders to a body which is co-rotatable with the output shaft has been disclosed in prior patents, see for example, U.S. Pat. No. 4,420,945 to DIBRELL. In such prior patent, however, a free piston is employed and, according to computer evaluations of the DIBRELL design, the overall efficiency of the device to produce mechanical energy in rotational form is not competitive with conventional forms of fluid pressure actuated piston engines. There is no question, however, but that energy is extracted from the pressured gas supplied to the cylinder. The problem is the efficient conversion of the extracted energy into a rotational form, without employing the expensive crank shaft and connecting rod constructions of the prior art.

SUMMARY OF THE INVENTION

This invention provides a plurality of peripherally spaced cylinders mounted in generally tangential relationship to the periphery of a housing defining an enclosed cylindrical fluid pressure chamber, which housing is keyed to an output shaft which is rotatably supported by suitable bearings. Each of the tangentially disposed cylinders co-operates with a piston. Each piston, in turn, is connected by a connecting rod to a housing or casing element of a undirectional clutch which is mounted for rotation about a fixed shaft projecting into the fluid pressure chamber in concentric relationship to the rotatable output shaft. The unidirectional clutch may comprise any one of several well known forms currently available on the market, and it is constructed so as to prevent movement of the pistons in a direction away from the closed end of the cylinders, but to readily permit movement of the pistons in a direction toward the closed end of the cylinders. The interconnection of the pistons to a common housing element of the unidirectional clutch assures that all of the pistons will move in synchronism and, hence, eliminates the necessity for elaborate electronic control circuitry to insure the synchronous movement of the pistons.

The inner ends of each of the cylinders are in open communication with the cylindrical fluid pressure chamber. The gas pressure within such chamber is regulated to maintain at all times a value that is in excess of atmospheric or ambient pressure. As each piston approaches the inner end of its respective cylinder, due to the movement of the cylinder away from the respective piston, a radial port in the cylinder is then uncovered by the piston, thus assuring that the outer face of the piston is exposed only to atmospheric or ambient pressure during most of its return stroke. Thus, the regulated internal pressure of the cylindrical fluid pressure chamber acts on the inner face of each piston to stop its inward movement and relatively move the piston back through the cylinder to the outer closed end of the cylinder. This movement in this direction is freely permitted by the unidirectional clutch and hence the initial rotational movement of the cylinders in one direction is not reversed by the return movement of the pistons to positions adjacent the outer closed ends of the respective cylinders.

If it is desired to employ the engine embodying this invention as an internal combustion engine, then an injection type fuel system is connected to the inlet port of the inlet valve mechanism which is mounted in the closed end of each cylinder. Thus, a mixture of combustible fuel and air is introduced into each cylinder as the respective piston approaches the closed end of such cylinder and a spark plug is provided which is electrically fired by conventional circuitry to explode the combustible mixture and thus provide the pressured gas for operation of the engine.

The pressure required to maintain the cylindrical fluid pressure chamber at a pressure above atmospheric or ambient pressure may be derived from a compressor driven by the output shaft of the engine in the case of an internal combustion engine application. When a source of pressured gas is employed to drive the engine, such as a pressured gas developed by operation of a solar energy conversion unit, then this pressured gas may be supplied through an appropriate pressure regulator to the enclosed cylindrical fluid pressure chamber to maintain the internal pressure in the chamber at a level above atmospheric or ambient, thus insuring the return of the pistons to the outer closed ends of the cylinder after each power stroke of the cylinders relative to the pistons.

Lubrication of the pistons, cylinders and the unidirectional clutch may be conveniently accomplished through the introduction of a pool of lubricating fluid into the enclosed fluid pressure chamber. Since all of the aforementioned elements are exposed to the interior of the chamber, and the chamber is rotating, it is obvious that the normal splashing movement of the fluid generated by the rotation of the chamber and the movements of the connecting rods will supply all of the internal parts with adequate lubrication.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
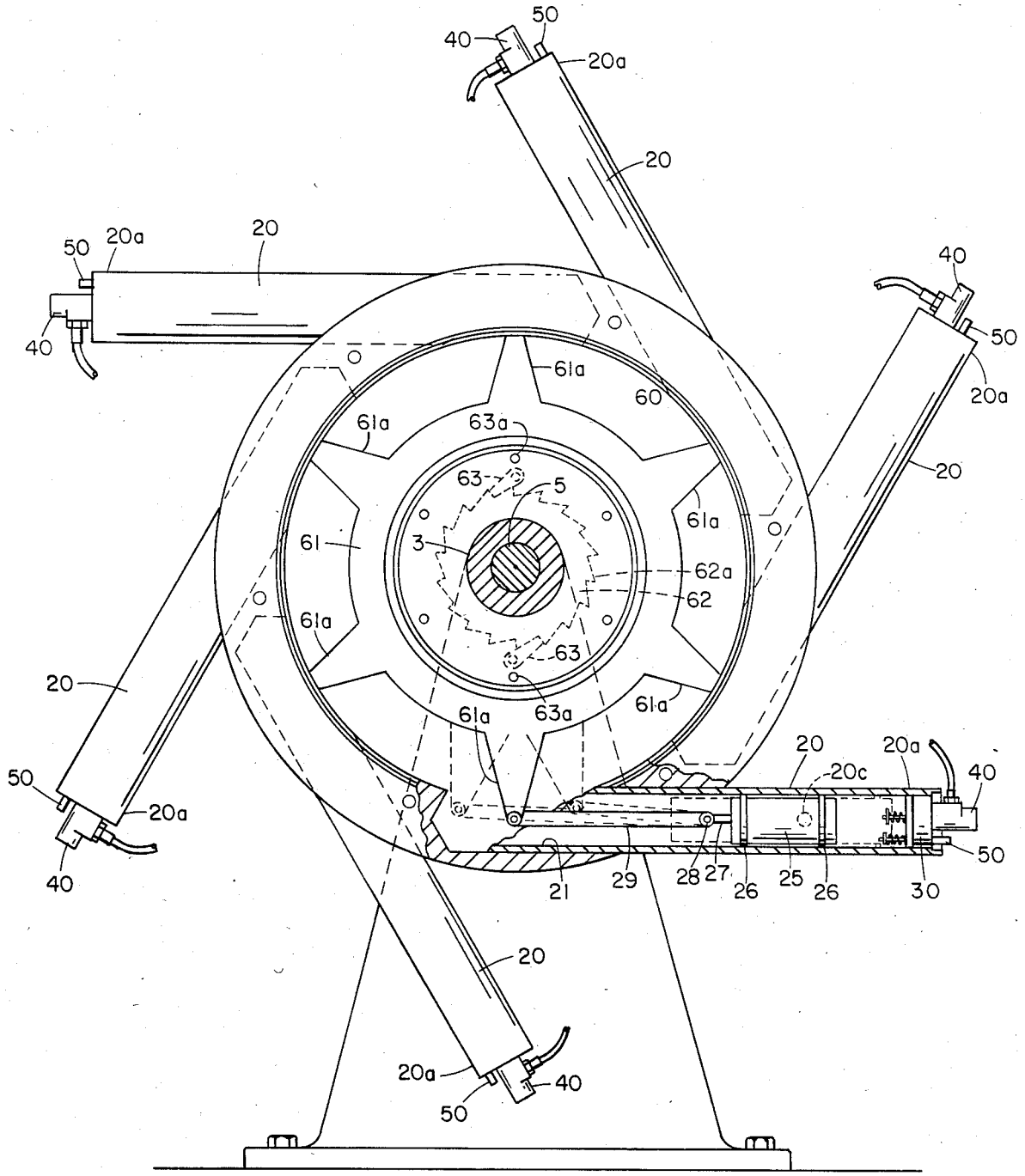
FIG. 1 is a schematic elevational view, partly in section and with the cover plate removed, of a fluid pressure operated rotary engine embodying this invention.
Figure 2:
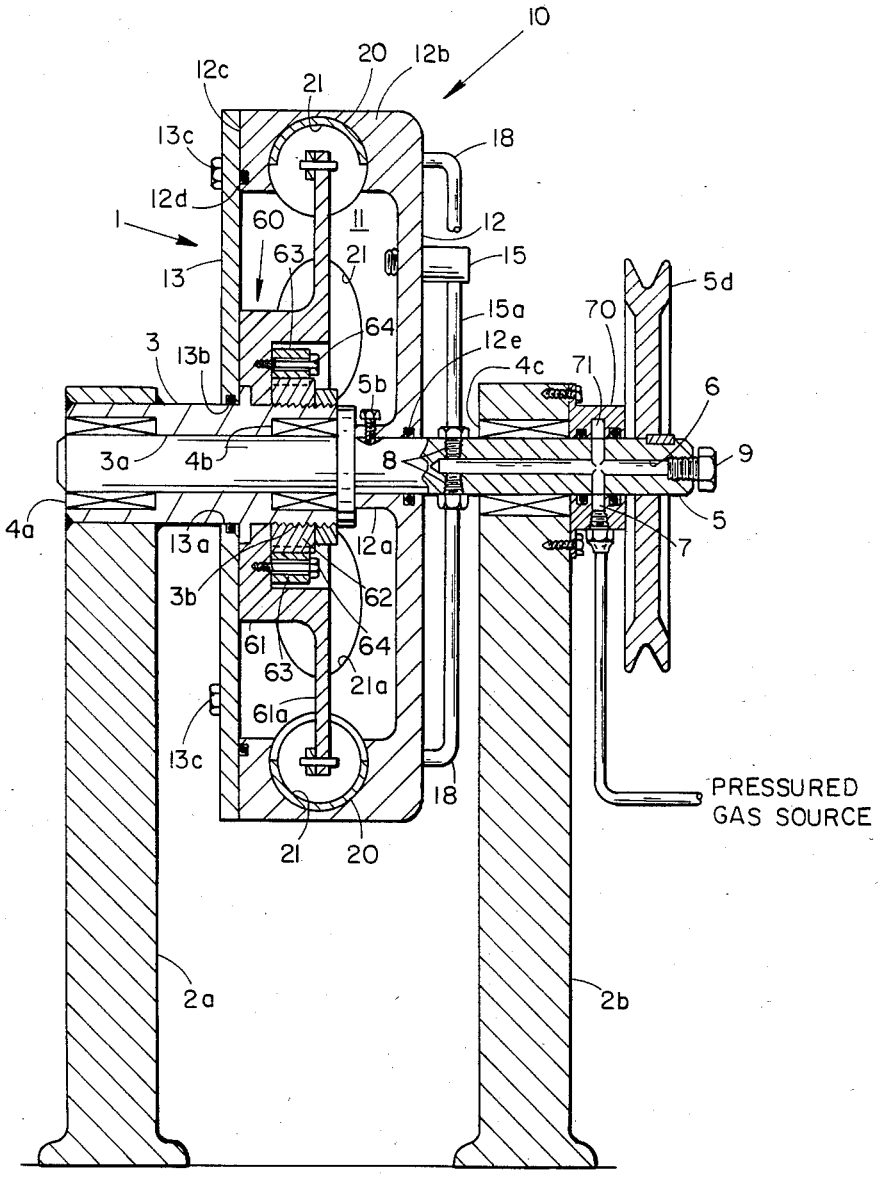
FIG. 2 is a vertical, sectional view of the complete engine of FIG. 1.

Referring particularly to FIGS. 1 and 2, an apparatus 1 embodying this invention comprises a pair of laterally spaced bearing pillars 2*a* and 2*b*. A hollow fixed shaft 3 is suitably mounted in the bearing pillar 2*a*, as by welding, and defines a bore 3*a* within which are mounted a pair of axially spaced conventional anti-friction bearings 4*a* and 4*b*. A third anti-friction bearing 4*c* is mounted in the upper portions of pillar 2*b* in aligned, concentric relationship with bearings 4*a* and 4*b* and a rotatable power output shaft 5 is supported by bearings 4*a*, 4*b* and 4*c*. Output shaft 5 may be utilized to drive any type of mechanism requiring a rotary input and, for convenience of illustration, the output device is represented in the drawings as a pulley 5*d* which is keyed to output shaft 5 for co-rotation. A cylinder mounting housing 10 is supported by output shaft 5 between the bearing pillars 2*a* and 2*b* and is secured to output shaft 5 for co-rotation by any convenient means, such as a key 5*a* and a set screw 5*b* which traverses a hub portion 12*a* of the housing 10.

Housing 10 defines a generally cylindrical fluid pressure chamber 11 concentrically surrounding the axis of the output shaft 5. The housing 10 may conveniently be formed in two pieces, the one piece 12 being a generally cup-shaped element having a central hub portion 12*a* by which it is mounted on and secured to the shaft 5 for co-rotation. The second piece comprises a circular cover plate 13 having a central opening 13*a* rotatably mounted on the exterior of the fixed shaft 3 and sealed thereto by an O-ring 13*b*. Cover plate 13 is secured to the rim of the annular wall portion 12*b* of the cup shaped housing part 12 by a plurality of peripherally spaced bolts 13*c* and the chamber 11 is sealed by an O-ring 12*d* provided in the radial end face 12*c* of the annular wall portion 12*b* and cooperating with the outer periphery of circular plate 13. Additionally an O-ring 12*e* is provided between the hub portion 12*a* of the cup-shaped element 12 of the housing 10 and the output shaft 5. The bearing element 4*b* is conventionally provided with seals to prevent leakage between the bearing holes. The inner end of the bore 21 of the cylinder 20 is in fluid communication with the cylindrical fluid pressure chamber 11. The outer ends of each cylinder are closed by a cylinder head assemblage 30 containing both an inlet valve 40 and an exhaust valve 50, both of which will be described hereinafter.

Within each of the cylinders 20, a piston 25 of conventional cylindrical configuration and carrying a pair of piston rings 26, is slidably mounted for reciprocating movements therein. Each of the pistons 25 has a stem portion 27 defining a pivot bore for receiving a wrist pin 28 which pivotally connects a connecting rod 29 to a pivot projection 61*a* formed on the outer housing or casing 61 of a unidirectional clutch 60.

Unidirectional clutch 60 is of the class referred to in the art as a sprag type unidirectional clutch, and incorporates a central element 62 which is threadably secured on the fixed shaft 3 by external threads 3*b* and a locking ring 3*c*. The teeth 62*a* of the central clutch element 62 are constructed to prevent clockwise rotation of the housing 61 relative thereto, but freely permit counter clockwise relative rotation of the housing 61. Housing 61 is connected to the teeth 62*a* by a plurality of peripherally spaced sprags or detents 63 which are pivotally mounted in conventional fashion on housing 61 on bolts 64 and spring biased by an appropriate torsion spring 63*a* into abutting engagement with the teeth 62*a*. Counter clockwise rotation of the housing 61 will cause the detents 63 to freely ride over the teeth 62*a*, but any tendency of the housing 61 to rotate in a clockwise direction will be prevented by the shape of the teeth 62*a*.

Since, as previously mentioned, the pistons 25 are all connected to the unidirectional clutch housing 61, this means that movement of the pistons away from the closed outer cylinder ends 20*a* is prevented by the unidirectional clutch 60, while at the same time, movement of the pistons toward the closed ends 20*a* of the cylinders 20 is freely permitted by the unidirectional clutch 60.

Figure 3:
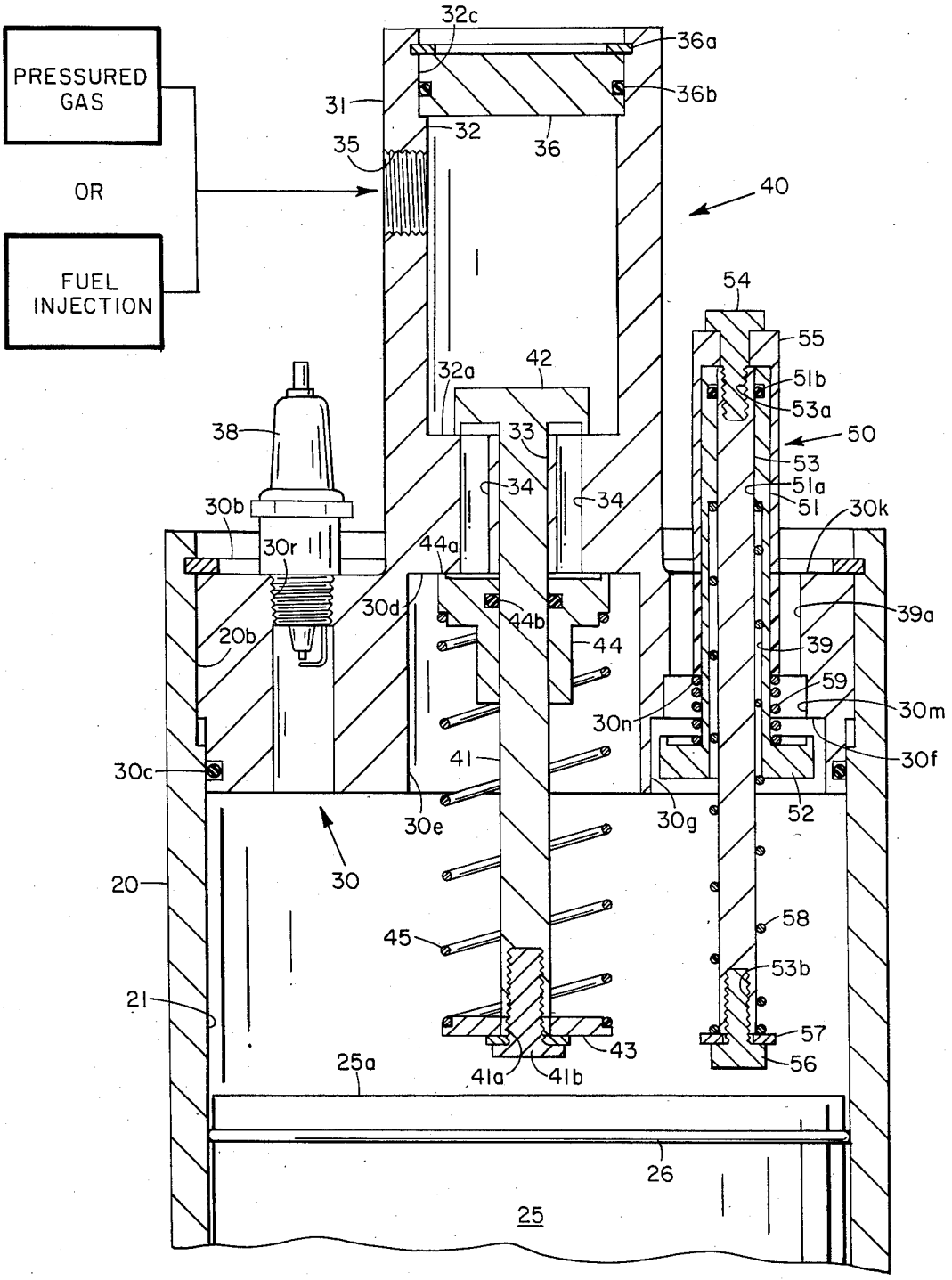
FIG. 3 is an enlarged scale, sectional view taken through the axis of the outer end of one of the cylinders of FIG. 1, illustrating the details of the inlet and exhaust valve mechanisms, together with the location of a spark plug in the event the engine is utilized as an internal combustion engine.
Figure 1:
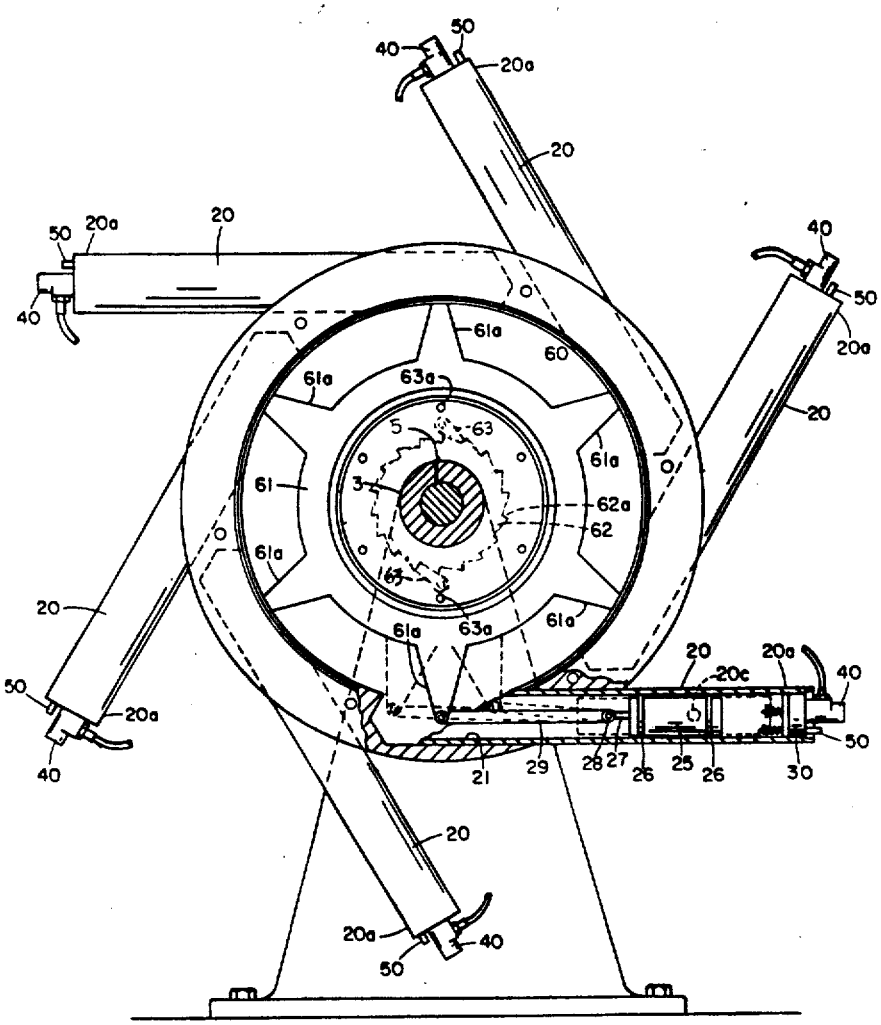

Referring now particularly to FIG. 3, the outer end 20*a* of each cylinder 20 is closed by a cylinder head 30 tional circuitry at the appropriate time to ignite the combustible mixture of fuel and air.

The inlet valve 40 comprises a stem type valve having a head portion 42 which overlies all of the fluid inlet passages 34 and effects a sealing engagement with the inner end wall 32*a* of the fluid pressure inlet chamber 32. Head portion 42 has an integrally formed, solid stem portion 41 projecting into the cylinder chamber 21. The internal end of stem 41 is internally threaded as indicated at 41*a* to receive a bolt 41*b* which mounts a spring seat 43 against the end of the stem portion 41.

An inlet check valve 44 comprises an annular block which is mounted in sliding but sealable relationship on the internal end of stem 41. O-ring 44*b* provides the seal. Inlet check valve 44 is provided with an annular sealing surface 44*a* which overlaps all of the fluid inlet passages 34 and can effect a sealing engagement with the end wall 30*d* of a counter bore 30*e* provided in the inner face of the cylinder head 30. Inlet check valve 44 is urged into sealing engagement with the surface 30*d* by a spring 45 which operates between a peripheral shoulder provided on the valve block 44 and a peripheral shoulder provided on the spring seat 43. Thus, the spring 45 effects a biasing of the inlet valve block 44 into sealing engagement with the inlet ends of the fluid inlet passages 34 and, at the same time, provides a bias urging the stem valve head 42 into sealing engagement with the outer ends of the inlet fluid passages 34. The normal position of inlet valve 40 is closed, as illustrated in FIG. 3, wherein no contact of the inwardly projecting valve stem 41 has been established with the outer face 25*a* of the piston 25. Inlet valve 44 functions as a spring biased check valve between cylinder chamber 21 and inlet chamber 32 so as to prevent the reverse flow of pressured gas from the cylinder chamber 21 into the fluid pressure inlet chamber 32 when the piston 25 approaches the outermost end of its stroke.

Cylinder head 30 also defines an opening 39 passing entirely through the cylinder head which provides a mounting for the stem portion 51 of an exhaust valve 50. Additionally, a plurality of peripherally spaced exhaust passages 39*a* are provided around the stem opening 39.

The exhaust valve 50 is provided with a head portion 52 which overlaps the inner ends of all of the fluid exhaust passages 39*a* and effects a sealing engagement with a radial surface 30*f* formed in the bottom of a counter bore 30*g* which encompasses all of the exhaust fluid passages 39*a*. The stem portion 51 of the exhaust valve 50 is integrally formed with the head portion, is of tubular configuration, and extends slidably through the exhaust valve opening 39. Stem portion 51 is provided at its outer end with a reduced diameter internal bore 51*a* providing a mounting for an actuating rod 53. An O-ring 51*b* effects the required seal between the actuating rod 53 and the bore 51*a*.

The outer end portion of the actuating rod 53 is provided with a threaded bore 53*a* for receiving a bolt 54. Bolt 54 secures a positioning collar 55 to the end of the valve stem. Collar 55 has its inner end face abutting the outer face 30*k* of the cylinder head 30. The other end of the actuating rod 53 projects into the cylinder chamber 21 and is also provided with a threaded bore 53*b* and a bolt 56 is mounted in such threaded bore and provides a securement thereto of a spring seat 57. A spring 58 is then mounted between spring seat 57 and the internally projecting shoulder defined between the reduced diameter bore portion 51*a* of the valve stem 51 and the remainder of the hollow exhaust valve stem. Thus, so long as the actuating rod 53 is not shifted by the piston 25, the spring 58 does not maintain the exhaust valve 50 in its closed position. A relatively light spring 59 is provided which operates between the outer face of the head portion 52 of the exhaust valve 50 and the end wall 30*n* of a counterbore 30*m* in the cylinder head 30 to maintain the exhaust valve in its illustrated position in FIG. 3 wherein it is not in sealing engagement with respect to the exhaust fluid passages 39*a*.

The operation of the aforedescribed inlet and exhaust valves as a function of the movement of piston 25 will be readily understood by those skilled in the art. As the piston 25 moves outwardly in the respective cylinder chamber 21, it first engages the bolt 56 and shifts the actuating rod 53 of the exhaust valve outwardly, thus compressing the light spring 59. This forces the exhaust valve 50 to move to its closed position. The inlet valve 40 was already in its closed position and remains in its closed position until the outer face 25*a* of piston 25 contacts the head of bolt 41*b* and displaces the inlet valve 30 in an outward direction, thus opening the inlet fluid passages 34 and permitting pressured gas to be supplied to the cylinder chamber 21 from the inlet fluid pressure chamber 32. Such supply of pressured gas continues so long as the fluid pressure on the cylinder side of the cylinder head 30 is less than the fluid pressure in the inlet fluid pressure chamber 32. Whenever the gas pressure in cylinder 21 builds up to a point where it is in excess of the pressure in the fluid inlet chamber 32, the inlet check valve 44 will be shifted from its open position to the closed position shown in FIG. 3 and further supply of inlet gas will be cut off. Thus, both the inlet valve 40 and the exhaust valve 50 are in closed positions as the piston 25 nears the outer end of its stroke and the gas trapped between the outer face 25*a* of the piston 25 and the cylinder head 30 will be compressed to a sufficiently high value to insure that the piston will be brought to a cushioned stop and its motion reversed by the compressed gases. It will, of course, be recognized, that the aforedescribed motion of the piston is a motion relative to the cylinder and that the cooperating cylinder is actually moving while the piston remains in a fixed position due to the action of the unidirectional clutch 60. Thus, in the arrangement illustrated in the drawings, the cylinders 20 will be moved relative to the respective pistons 25 in a direction to produce a counter clockwise rotation of the housing 10 upon which the cylinders 20 are rigidly mounted, thereby rotating the power output shaft 5.

As the piston moves relatively inwardly in the respective cylinder chamber 21, away from closed end 20*a*, the exhaust valve 50 remains in its closed position due to the excess of the internal pressure on the inner side of the valve over the ambient pressure existing on the other side of the valve. Similarly, the inlet check valve 44 will remain in its closed position, due to the pressure differential across such valve until the stem portion 41 of the inlet valve 40 has returned to its normal position under the bias of the spring 45, at which point the head 42 of the inlet valve 40 will effect the sealing of the inlet fluid passages 34. The pressured gas acting on the piston-cylinder is thus expanded and cooled.

As the piston 25 approaches the inner end of its relative inward stroke, it uncovers a radial port 20*c* (FIG. 1) provided in the wall of cylinder 20 and thus permits the dumping of the remaining pressure in the cylinder chamber 21 to atmosphere or ambient, thus discharging a cooled, expanded gas. This permits the exhaust valve 50 to be moved to its open position under the influence of the relatively light spring 59 and the valving system is then ready for another cycle of operations.

The structure and operation of the aforedescribed inlet valve 40 and outlet valve 50 forms the subject matter of U.S. application Ser. No. 617,288, filed 6/4/84, and assigned to the Assignee of this invention and reference should be had to such application for any further details concerning the construction and operation of the inlet and outlet valves.

From the foregoing description, it will be apparent that the operation of the inlet and exhaust valves is entirely controlled by the position of the respective piston, and the action of such valves in moving to the required open or closed position is substantially instantaneous, hence will not be adversely effected by the speed of relative reciprocation of the pistons 25. Of equal importance is the fact that all of the pistons 25 are moving concurrently due to their interconnection to the unidirectional clutch element 60.

To supply the pressured gas or a mixture of combustible fuel and air to the outer closed ends 20*a* of each cylinder 20, a conventional fluid coupling 70 is secured to the pillar 2*b* in surrounding relationship to the rotatable output shaft 5. Shaft 5 is provided with an internal bore 6 which extends through the pillar 2*b*. Plug 9 seals the end of the bore 6. Bore 6 is connected to an annular chamber 71 conventionally formed in the fluid coupling element 70 by a plurality of radial ports 7 which extend from the central bore 6 to the periphery of the rotatable shaft 5. Seals 73 prevent leakage of the supplied gas from the fluid coupling 70.

In like fashion, a plurality of radial ports 8 extend from the inner end of the bore 6 to the periphery of the rotatable shaft 5 and communicate with pipes 18 which extend to the inlet valves 40 provided in the outer end of each cylinder 20. Additionally, a pipe 15*a* extends from a radial port 84 to the fluid pressure regulator 15 to supply the required pressure to maintain the internal fluid pressure in the chamber 11, except when engine 1 functions as an internal combustion engine in which case, pressured air is supplied from a separate source.

As previously stated, the internal fluid pressure in chamber 11 is maintained by pressure regulator 15 at a value above the ambient or atmospheric pressure surrounding the engine 1. The amount that the gas pressure in internal pressure chamber 11 exceeds the atmospheric or ambient pressure is just sufficient to insure the stopping of the inward motion of the pistons 25 after exhaust valve 20*c* is opened and to reverse the motion of such pistons to return them to the outer ends 20*a* of the cylinders 20. Obviously, the outward motion of the pistons is slightly aided by centrifugal force since the pistons are moving away from the axis of rotation. Since it is preferable that the pistons 25 be of relatively light weight construction, it is readily apparent that no substantial pressure differential need be maintained in the internal fluid pressure chamber 11.

Due to the fact that the fluid pressure in the cylindrical fluid pressure chamber 11 is always maintained by regulator 15 at a value in excess of the atmospheric or ambient pressures, a relative motion of the pistons 25 with respect to the cylinders 20 occurs, but this does not effect a reversal of rotation already imparted to the housing 10 and the rotary output shaft 5. Some slowing down of the rate of rotation of the housing 10 and output shaft 5 may occur due to the fact that the rotational momentum of the rotating apparatus would be increased as the mass of the pistons is moved farther from the axis of rotation, hence the angular velocity will decrease, but by using relatively lightweight pistons, and relatively heavier cylinders 60 and housing 10, this effect is substantially negligible. In addition, it is offset by the flywheel effect of the load connected to the rotary engine through pulley 5*d*. Additionally, the outward movement of pistons 25 effects a compression of the ambient gas in cylinders 20 once the ports 20*c* and exhaust valve 50 are closed. This produces a force on the closed cylinder ends to aid the rotation of housing 10 and output shaft 5. Thus, the energy of the supplied pressured gas or the pressured gas developed by the ignition of the mixture of combustible fuel and air, is efficiently converted into a rotary output motion. It should be particularly noted that the torque arm upon which the pressured gas operates is always constant, thus overcoming a major disadvantage of the conventional crank shaft and connecting the rod arrangement.

Lubrication of the described device may be accomplished in a variety of manners, including the introduction of lubricating fluid as a mist suspended in the pressured gas. Because of the fact that the cylindrical fluid pressure chamber 11 is completely sealed, the lubrication can be effectively accomplished by introducing a small quantity of lubricating fluid directly into such chamber and such fluid will be distributed over all of the working surfaces of the pistons, cylinders and the unidirectional clutch assembly due to the rotation of the device and the reciprocating movement of the connecting rods. The combination of such movements insure that lubricant fluid will be splashed onto all of the surfaces requiring lubrication, except, of course, the antifriction bearing elements 4*a*, 4*b* and 4*c* which are presealed with a lubricant.

If the available pressured gas is air at modest pressures (50–150 psi) then the exhaust valves 50 and exhaust ports 20*c* can vent directly to atmosphere. On the other hand, if the pressure source is gas from a well, and particularly high pressure gas, it would be undesirable to exhaust into the atmosphere. In such cases, the engine 1 may be enclosed to recover the exhaust gas at a suitable ambient level, well above atmospheric pressure, thus permitting further energy extraction from the pressured exhaust gas.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirt of the described invention.

I claim:

1. A gas pressure operated engine comprising a rotatable output shaft; a hollow housing secured to said output shaft for co-rotation and defining a chamber around the axis of said output shaft; at least one cylinder mounted on said housing with its axis in radially spaced, generally tangential relationship to the chamber; said cylinder having an open inner end communicating with said chamber and a closed outer end disposed exteriorly of said chamber; means in said closed end for supplying pressured gas to said cylinder; a piston reciprocably mounted in said cylinder for relative movement toward and away from said closed cylinder end; unidirectional clutch means mounted in said chamber; and means connecting said piston to said unidirectional clutch means to prevent movement of said piston in the direction away from said closed cylinder end but permit unobstructed movement of said piston toward said closed cylinder end, whereby said closed cylinder end moves away from said piston upon introduction of gas pressure in said closed end of said cylinders; and means for maintaining an above ambient gas pressure in said chamber sufficient to return said piston to said closed cylinder end.

2. An engine in accordance with claim 1 further comprising an exhaust port in a medial portion of said cylinder located to be uncovered by said movement of said piston toward said open end of said cylinder.

3. A gas pressure operated engine comprising a rotatable output shaft; a hollow housing secured to said output shaft for co-rotation and defining a chamber around the axis of said output shaft; at least one cylinder mounted on said housing with its axis in radially spaced, generally tangential relationship to the chamber; said cylinder having an open inner end communicating with said fluid pressure chamber and a closed outer end disposed exteriorly of said chamber; means in said closed end for supplying pressured gas to said cylinder; a piston reciprocably mounted in said cylinder for relative movement toward and away from said closed cylinder end; unidirectional clutch means mounted in said chamber; means connecting said piston to said unidirectional clutch means to prevent movement of said piston in the direction away from said closed cylinder end but permit unobstructed movement of said piston toward said closed cylinder end, whereby said closed cylinder end moves away from said piston upon introduction of gas pressure in said closed end of said cylinder; means for reducing the gas pressure in said closed end of said cylinder to ambient when said piston approaches said open end of said cylinder; and means for maintaining an above ambient gas pressure in said chamber sufficient to return said piston to said closed cylinder end.

4. An engine in accordance with claim 3 wherein said means for reducing the gas pressure in said closed end of said cylinder to ambient comprises a radial exhaust port in a medial portion of said cylinder located to be uncovered by said movement of said piston toward said open end of said cylinder.

5. An engine in accordance with claim 3 wherein said means for maintaining a gas pressure in said fluid pressure chamber above ambient pressure comprises a pressure regulator connected between said fluid pressure chamber, ambient pressure and a source of pressured gas.

6. An engine in accordance with claims 1, 2, 3, 4 or 5 wherein said means for supplying pressured gas to said closed end of said cylinder comprises an inlet valve operatively connected between said closed end of said cylinder and a source of pressured gas, and means for opening said inlet valve when said piston approaches said closed end of said cylinder.

7. An engine in accordance with claims 1, 2, 3, 4 or 5 wherein said means for supplying pressured gas to said closed end of said cylinder comprises means for producing a pressurized combustible mixture of explosive fuel and air; an inlet valve operatively connected between said closed end of said cylinder and said last mentioned means; means for opening said inlet valve when said piston approaches said closed end of said cylinder; and further comprising means for igniting said combustible mixture when said piston is adjacent said closed end of said cylinder.

8. A gas pressure operated engine comprising a rotatable output shaft; a hollow housing secured to said output shaft for co-rotation and defining a chamber around the axis of said output shaft; a plurality of cylinders mounted on said housing in equi-peripherally spaced relation, each cylinder having its axis disposed in radially spaced, generally tangential relationship to the chamber; each said cylinder having an open inner end communicating with said chamber and a closed end disposed exteriorly of said chamber; a piston reciprocably mounted in each said cylinder for relative movement toward and away from said closed cylinder end; unidirectional clutch means mounted in said chamber; and means connecting each of said pistons to said unidirectional clutch means to prevent movement of said piston in the direction away from said closed cylinder end but permit movement of said piston toward said closed cylinder end, whereby said closed cylinder end moves away from said piston upon introduction of gas pressure in said closed end of said cylinder; and means for maintaining an above ambient gas pressure in said chamber sufficient to return said piston to said closed cylinder end.

9. An engine in accordance with claim 8 further comprising an exhaust port in a medial portion of each said cylinder located to be uncovered by said movement of said piston toward said open end of said cylinder.

10. A gas pressure operated engine comprising a rotatable output shaft; a hollow housing secured to said output shaft for co-rotation and defining a chamber around the axis of said output shaft; a plurality of cylinders mounted on said housing in equi-peripherally spaced relation, each cylinder having its axis disposed in radially spaced, generally tangential relationship to the chamber; each said cylinder having an open inner end communicating with said chamber and a closed end disposed exteriorly of said chamber; means in said closed end for supplying pressured gas to said cylinder; a piston reciprocably mounted in said cylinder for relative movement toward and away from said closed cylinder end; unidirectional clutch means mounted in said chamber; and means connecting each of said pistons to said unidirectional clutch means to prevent movement of each said piston in the direction away from said closed cylinder end but permit movement of each said piston toward said closed cylinder end, whereby said closed cylinder end moves away from said piston upon introduction of gas pressure in said closed end of said cylinder; means for reducing the gas pressure in said closed end of each said cylinder to ambient when each said piston approaches said open end of said cylinder; and means for maintaining an above ambient gas pressure in said chamber sufficient to return said piston to said closed cylinder end.

11. A gas pressure operated engine comprising a rotatable output shaft; a hollow housing secured to said output shaft for co-rotation and defining a fluid pressure chamber around the axis of said output shaft; means for maintaining a gas pressure in said fluid pressure chamber above ambient pressure; a plurality of cylinders mounted on said housing in equi-peripherally spaced relation, each cylinder having its axis disposed in radially spaced, generally tangential relationship to the chamber; each said cylinder having an open inner end communicating with said fluid pressure chamber and a closed end; means in said closed end for supplying pressured gas to said cylinder; a piston reciprocably mounted in said cylinder for relative movement toward and away from said closed cylinder end; unidirectional clutch means in said chamber; and means connecting each said piston to said unidirectional clutch means to prevent movement of each said piston in the direction away from said closed cylinder but permit movement of each said piston toward said closed cylinder end, whereby each said closed cylinder end moves away from said respective piston upon introduction of gas pressure in said closed end of said cylinder; and means for reducing the gas pressure in said cylinder to ambient when said respective piston approaches said open end of said cylinder.

12. An engine in accordance with claim 11 wherein said last mentioned means comprises a radial exhaust port in a medial portion of each said cylinder located to be uncovered by said movement of said respective piston toward said open end of said cylinder.

13. An engine in accordance with claim 11 wherein said means for maintaining a gas pressure in said fluid pressure chamber above ambient pressure comprises a pressure regulator connected between said fluid pressure chamber, ambient pressure and a source of pressured gas.

14. An engine in accordance with claims 8, 9, 10, 11, 12, or 13 wherein said means for supplying pressured gas to said closed end of each said cylinder comprises an inlet valve operatively connected between said closed end of said cylinder and a source of pressured gas, and means for opening said inlet valve when said respective piston approaches said closed end of said cylinder.

15. An engine in accordance with claims 8, 9, 10, 11, 12 or 13 wherein said means for supplying pressured gas to said closed end of each said cylinder comprises means for producing a pressurized combustible mixture of explosive fuel and air; an inlet valve operatively connected between said closed end of said cylinder and said last mentioned means; means for opening said inlet valve when said respective piston approaches said closed end of said cylinder; and further comprising means for igniting said combustible mixture when said piston is adjacent said closed end of said cylinder.

16. An engine in accordance with claims 1, 3, 8 or 11 further comprising a fixed shaft projecting into said chamber in co-axial relationship to said output shaft; said unidirectional clutch means being mounted on said fixed shaft.

17. An engine in accordance with claims 1, 3, 8 or 11 further comprising a fixed hollow shaft projecting into said chamber in co-axial relationship to said output shaft; said unidirectional clutch means being mounted on the exterior of said fixed hollow shaft; and bearing means in the bore of said fixed hollow shaft for supporting said output shaft.

18. An engine in accordance with claims 1, 3, 8 or 11 further comprising a quantity of lubricating fluid confined in said chamber for lubricating each said cylinder, piston and said unidirectional clutch means.

19. The method of producing rotational energy from a plurality of linearly reciprocable piston and cylinder units comprising the steps of:

(1) disposing the cylinders in peripherally spaced relation about the axis of a rotatable housing defining a chamber, and tangential thereto; said cylinders having an outer closed end and an inner open end communicating with said chamber;

(2) connecting the pistons to a unidirectional clutch mounted in said chamber to prevent movement of said pistons away from the respective closed cylinder ends, but permitting unrestricted relative movement of said pistons toward said closed cylinder ends;

(3) introducing a pressurized gas in said closed cylinder ends, thereby producing rotational movement of said cylinders and housing in one direction;

(4) exhausting said pressured gas to ambient pressure as said pistons approach said inner ends of said respective cylinders by said rotational movement of said cylinders; and (5) maintaining an above ambient gas pressure in said chamber sufficient to move said pistons toward said closed ends of the respective cylinders.

20. The method of claim 19 further comprising the step of inserting a quantity of lubricating fluid in said chamber to splash lubricate all components in said chamber.

21. The method of extracting mechanical energy from a pressured gas supplied to a plurality of linearly reciprocable piston and cylinder units comprising the steps of:

(1) disposing the cylinders in peripherally spaced relation about the axis of a rotatable housing defining a chamber, and tangential thereto; said cylinders each having an outer closed end and an inner open end communicating with said chamber;

(2) connecting the pistons to a unidirectional clutch mounted in said chamber to prevent movement of said pistons away from the respective closed cylinder ends, but permitting unrestricted relative movement of said pistons toward said closed cylinder ends;

(3) introducing a pressurized gas in said closed cylinder ends and permitting said gas to expand and cool, thereby producing rotational movement of said cylinders and housing in one direction;

(4) exhausting said cooled and expanded gas to ambient pressure as said pistons approach said inner ends of said respective cylinders; and (5) maintaining an above ambient gas pressure in said chamber sufficient to return said pistons to said closed ends of the respective cylinders.

22. Apparatus for extracting mechanical energy from a pressured gas comprising a rotatable output shaft; a hollow housing secured to said output shaft for co-rotation and defining a chamber around the axis of said output shaft; at least one cylinder mounted on said housing with its axis in radially spaced, generally tangential relationship to the chamber; said cylinder having an open inner end communicating with said chamber and a closed outer end disposed exteriorly of said chamber; means in said closed end for supplying pressured gas to said cylinder; a piston reciprocably mounted in said cylinder for relative movement toward and away from said closed cylinder end; unidirectional clutch means mounted in said chamber; means connecting said piston to said unidirectional clutch means to prevent movement of said piston in the direction away from said closed cylinder end, whereby said closed cylinder end moves away from said piston upon introduction of gas pressure in said closed end of said cylinders by expansion and cooling of said pressured gas; an exhaust port in a medial portion of said cylinder located to be uncovered by said movement of said piston toward said open end of said cylinder to discharge the expanded and cooled gas; and means for maintaining an above ambient gas pressure in said chamber sufficient to return said piston to said closed cylinder end.

23. Apparatus for extracting mechanical energy from a pressured gas comprising a rotatable output shaft; a hollow housing surrounding said output shaft and defining a chamber around the axis of said output shaft; at least one cylinder mounted on said housing with its axis in radially spaced, generally tangential relationship to the chamber; said cylinder having an open inner end communicating with said chamber and a closed outer end disposed exteriorly of said chamber; means in said closed end for supplying pressured gas to said cylinder; a piston reciprocably mounted in said cylinder for relative movement toward and away from said closed cylinder end; unidirectional clutch means disposed in said chamber; means connecting said piston to said unidirectional clutch means whereby relative linear movement of said piston away from said closed end of said cylinder produces rotation of said output shaft while relative linear movement of said piston toward said closed end of said cylinder is independent of said output shaft; means for producing a pressured gas in said closed cylinder end as said piston approaches said closed end, thereby relatively moving said piston toward said open end of said cylinder and rotating said output shaft; means for exhausting said pressured gas to ambient as said piston approaches said open cylinder end; and means for maintaining an above ambient gas pressure in said chamber sufficient to return said piston to said closed end of said cylinder.

* * * * *

UNITED STATES PATENT AND TRADEMARK OFFICE

CERTIFICATE OF CORRECTION

PATENT NO. : 4,558,666

DATED : Dec. 17, 1985

INVENTOR(S) : Wilbur A. Schaich

It is certified that error appears in the above-identified patent and that said Letters Patent is hereby corrected as shown below:

The title page should be deleted to appear as per attached title page.

The sheet of Drawing consisting of Figure 1 should be deleted to appear as per attached sheet.

Signed and Sealed this

*First* Day of *April 1986*

[SEAL]

*Attest:*

DONALD J. QUIGG

*Attesting Officer*

*Commissioner of Patents and Trademarks*

United States Patent [19]

Schaich

[11] Patent Number: 4,558,666

[45] Date of Patent: Dec. 17, 1985

[54] ROTATING CYLINDER ENGINE AND METHOD OF OPERATING THE ENGINE

[75] Inventor: Wilbur A. Schaich, San Antonio, Tex.

[73] Assignee: Centrifugal Piston Expander, Inc., San Antonio, Tex.

[21] Appl. No.: 634,846

[22] Filed: Jul. 26, 1984

[51] Int. Cl.[4] ..... F02B 57/00

[52] U.S. Cl. ..... 123/43 R; 91/197; 91/273; 91/395; 91/398; 91/410; 92/66

[58] Field of Search ..... 91/176, 196, 197, 216 R, 91/216 A, 216 B, 217, 272, 273, 325, 395, 397, 398, 410; 92/66, 68, 147; 123/43 R, 43 B, 46 R

[56] References Cited

U.S. PATENT DOCUMENTS

| | | | |
|---|---|---|---|
| 668,822 | 2/1901 | MacLaury | 92/66 X |
| 1,158,238 | 10/1915 | Knowles | 91/176 |
| 1,380,404 | 6/1921 | Miller | 123/43 R |
| 1,764,324 | 6/1930 | Livingstone | 123/43 R X |
| 1,813,763 | 7/1931 | Price | 123/43 R |
| 1,823,132 | 9/1931 | Cunningham | 123/43 B |
| 1,917,180 | 7/1933 | Zwick . | |
| 2,334,655 | 11/1943 | Talbot | 123/43 R |
| 2,886,017 | 5/1959 | Dib . | |
| 2,982,261 | 5/1961 | McClintock | 123/43 R X |
| 3,974,801 | 8/1976 | Brown . | |
| 4,058,088 | 11/1977 | Brown . | |

FOREIGN PATENT DOCUMENTS

| | | | |
|---|---|---|---|
| 82363 | 7/1895 | Fed. Rep. of Germany | 123/43 R |
| 805456 | 5/1951 | Fed. Rep. of Germany | 123/43 R |

*Primary Examiner*—Michael Koczo
*Attorney, Agent, or Firm*—Norvell & Associates

[57] ABSTRACT

Method and apparatus for producing rotation of a power output shaft comprises a plurality of peripherally spaced cylinders disposed in generally tangential relationship to the periphery of a housing defining a cylindrical fluid pressure chamber and connected at their inner ends to such fluid pressure chamber. The housing is mounted on, and co-rotatable with the output shaft. The gas pressure in such chamber is regulated to maintain a selected value above ambient. Cooperating pistons in each of the cylinders are interconnected by connecting rods to a unidirectional clutch mounted in the fluid pressure chamber on a fixed shaft, thus forcing the cylinders to rotate when pressured gas is introduced in the outer ends of the cylinders. Inlet and exhaust valves are provided in a cylinder head mounted in the outer end of each cylinder and are operable by contact with the outer face of the respective piston. A radial exhaust port is uncovered by each piston as it nears the end of its power stroke, thus reducing the fluid pressure on the outer piston face to ambient and permitting the regulated gas pressure in the fluid pressure chamber to effect the return of the pistons to their outermost positions relative to the respective cylinders, thus producing a net unidirectional torque on the housing to rotate the output shaft.

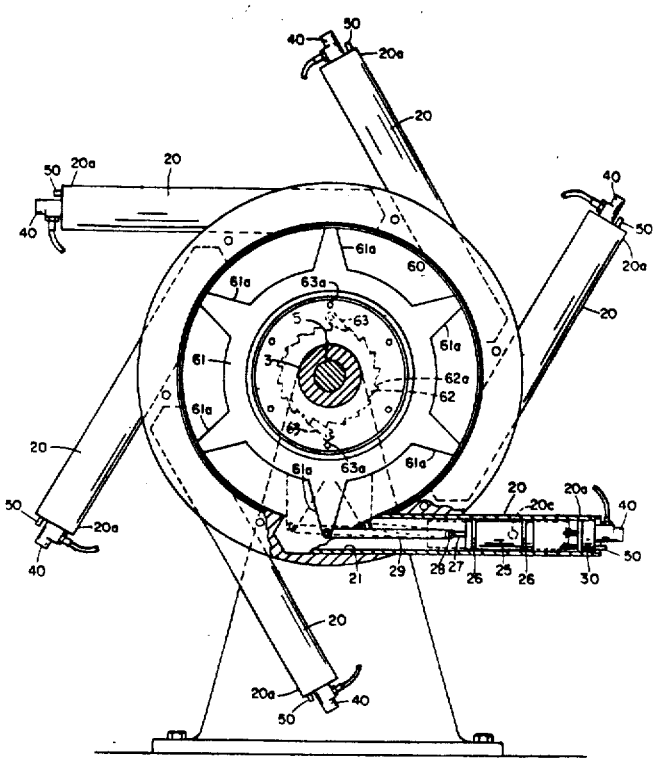

23 Claims, 3 Drawing Figures